US007758176B2

(12) United States Patent
Kojima

(10) Patent No.: US 7,758,176 B2
(45) Date of Patent: Jul. 20, 2010

(54) IMAGE FORMING APPARATUS AND LIQUID CONTROL METHOD

(75) Inventor: Toshiya Kojima, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 154 days.

(21) Appl. No.: 12/173,617

(22) Filed: Jul. 15, 2008

(65) Prior Publication Data

US 2008/0278558 A1 Nov. 13, 2008

Related U.S. Application Data

(62) Division of application No. 11/061,542, filed on Feb. 18, 2005, now Pat. No. 7,416,294.

(30) Foreign Application Priority Data

Feb. 19, 2004 (JP) ..... 2004-042719

(51) Int. Cl.
*B41J 2/19* (2006.01)
*B41J 2/175* (2006.01)

(52) U.S. Cl. ..... 347/92; 347/85

(58) Field of Classification Search ..... 347/19, 347/30, 94, 85, 92
See application file for complete search history.

(56) References Cited

U.S. PATENT DOCUMENTS

| | | | | |
|---|---|---|---|---|
| 4,149,172 | A | 4/1979 | Heinzl et al. | |
| 4,301,459 | A | 11/1981 | Isayama et al. | |
| 5,808,643 | A | 9/1998 | Tracy et al. | |
| 5,875,615 | A | 3/1999 | Ito et al. | |
| 6,059,405 | A | 5/2000 | Mochizuki et al. | |
| 6,213,596 | B1 * | 4/2001 | Nowell et al. | 347/85 |
| 6,224,201 | B1 | 5/2001 | Shigemura et al. | |
| 6,901,659 | B1 | 6/2005 | Mishima et al. | |
| 7,014,303 | B2 * | 3/2006 | Matsushita et al. | 347/85 |
| 2001/0024223 | A1 | 9/2001 | Thielman et al. | |

FOREIGN PATENT DOCUMENTS

| | | | |
|---|---|---|---|
| JP | 09-193415 | A | 7/1997 |
| JP | 11-20194 | | 1/1999 |
| JP | 11-48491 | A | 2/1999 |
| JP | 2000-190529 | A | 7/2000 |
| JP | 2002-178533 | A | 6/2002 |
| JP | 2002-234185 | | 8/2002 |

* cited by examiner

*Primary Examiner*—Anh T. N. Vo
(74) *Attorney, Agent, or Firm*—Birch, Stewart, Kolasch & Birch, LLP

(57) ABSTRACT

The image forming apparatus comprises: a recording head which discharges droplets of liquid onto a recording medium; a dissolved gas amount estimating device which estimates an amount of dissolved gas contained in the liquid inside the recording head; and a liquid restoring device which carries out restoration processing of the liquid inside the recording head, if an estimated value of the amount of the dissolved gas estimated by the dissolved gas amount estimating device exceeds a prescribed reference value.

8 Claims, 13 Drawing Sheets

IMAGE FORMING APPARATUS AND LIQUID CONTROL METHOD

This Application is a Divisional of application Ser. No. 11/061,542 filed on Feb. 18, 2005 now U.S. Pat. No. 7,416, 294, and for which priority is claimed under 35 U.S.C. §120; and this Application claims priority of Application No. 2004-42719 filed in Japan on Feb. 19, 2004 under 35 U.S.C. §119; the entire contents of all are hereby incorporated by reference.

BACKGROUND OF THE INVENTION

1. Field of the Invention

The present invention relates to an image forming apparatus and a liquid control method, and more particularly, to a liquid droplet control technology for controlling the amount of dissolved gas in liquid droplets used to form an image on a recording medium, and maintaining the liquid droplets in a desirable state.

2. Description of the Related Art

In recent years, inkjet printers have come to be used widely as data output apparatuses for outputting images, documents, or the like. An inkjet printer forms data on recording paper by driving recording elements (nozzles) of a recording head in accordance with data, thereby causing ink to be discharged from the nozzles. Discharge devices for causing discharge of the ink include devices using PZT actuators, or the like, which apply a pressure wave to a pressure chamber connected to a nozzle, and devices using a heat source which heats ink contained in an ink chamber (pressure chamber) and thus generates bubbles in the ink. Ink pressurized by operating a discharge device of this kind is discharged from the nozzles and data, such as an image, is formed on a recording medium.

In an inkjet printer, if air bubbles become mixed into the ink inside the recording head, then there is significant loss of the pressure applied to the ink by the actuator, and this can lead to discharge abnormalities, such as abnormalities in the amount of ink discharged or the direction of discharge, discharge failures, and the like. Discharge abnormalities of this kind affect image recording and consequently cause a marked decline in the resulting image quality. Therefore, it is possible to maintain the quality of the recorded image by detecting discharge abnormalities swiftly and eliminating the causes of the discharge abnormalities.

A known method for preventing the occurrence of air bubbles inside a print head (pressure chamber), which are a cause of discharge abnormalities as described above, uses a so-called deaerated ink which has a reduced amount of gas dissolved in the ink.

Japanese Patent Application Publication No. 2000-190529 discloses a method for controlling the amount of dissolved gas in a liquid in an inkjet apparatus, an inkjet recording apparatus and a color filter manufacturing apparatus, according to which the amount of dissolved gas in unused ink that has been circulated within an inkjet head is measured, and the ink is circulated and dissolved gas is removed from the ink if the measurement value exceeds a prescribed value, in such a manner that the amount of dissolved gas in the ink is equal to or less than the prescribed value.

Furthermore, in the inkjet printer and the deaeration method for an inkjet printer described in Japanese Patent Application Publication No. 11-20194, a tube provided in the flow path of the ink is reduced in pressure, thereby removing air contained in the ink inside the tube.

In the inkjet recording apparatus described in Japanese Patent Application Publication No. 11-48491, a deaerating device comprising a hollow fiber filter is provided between an ink container and a recording head, in such a manner that ink passes through the deaerating device when supplied to the recording head.

However, if a deaerator and a dissolved oxygen meter for measuring the amount of dissolved gas in the ink are disposed in this sequence before a print head, from the upstream side of the ink flow path, then since there is no device for measuring the dissolved gas downstream of the dissolved oxygen meter, a problem arises in that the amount of dissolved gas in the ink inside the print head will remain as it is. The same also applies to systems which do not use a device, such as a dissolved oxygen meter, for measuring the dissolved gas in the ink.

In the method for controlling the amount of dissolved gas in a liquid inside an inkjet apparatus, the inkjet recording apparatus, and the color filter manufacturing apparatus according to Japanese Patent Application Publication No. 2000-190529, since there is a long distance between the dissolved oxygen meter that measures the amount of dissolved gas in the ink and the deaerator, then in cases where the apparatus is printing at low duty which does not consume ink, or where ink is held for a long time inside the inkjet head, or the like, it may occur that the amount of dissolved gas in the ink exceeds a specified value when it reaches the dissolved oxygen meter, even though the amount of dissolved gas does not exceed the specified value in the inkjet head section, and hence the apparatus halts printing and enters deaerating mode, thus causing time loss.

Furthermore, it is supposed that the deaerator used here has sufficiently high capacity with respect to the flow rate of the ink, but if the ink remains stationary for a long period of time, then the deaeration rate will exceed the specified value. Moreover, this patent publication does not provide any description relating to a multiple head in which a plurality of print heads are disposed. For example, if a deaerator is provided at one point of an ink supply path (in other words, before branching of the path), then it may not be possible to judge conditions accurately, due to differences in the use duty of the respective print heads. On the other hand, if deaerators are positioned after branching in a multiple head, and a dissolved oxygen meter is positioned downstream of the print heads on the circulation side, then the number of deaerators will increase and costs will rise.

Furthermore, in the inkjet printer and deaeration method for an inkjet printer according to Japanese Patent Application Publication No. 11-20194, and the inkjet recording apparatus according to Japanese Patent Application Publication No. 11-48491, a measuring device, such as a dissolved oxygen meter, for measuring the amount of dissolved gas in the ink is not provided, and therefore it is not possible to ascertain the amount of dissolved gas in the ink inside the apparatus.

SUMMARY OF THE INVENTION

The present invention has been contrived in view of such circumstances, and an object thereof is to provide an image forming apparatus and a liquid control method, whereby the amount of dissolved gas in the ink inside the recording head is ascertained and maintenance of the ink, such as deaeration, is carried out accordingly.

In order to attain the aforementioned object, the present invention is directed to an image forming apparatus, comprising: a recording head which discharges droplets of liquid onto a recording medium; a dissolved gas amount estimating device which estimates an amount of dissolved gas contained in the liquid inside the recording head; and a liquid restoring device which carries out restoration processing of the liquid inside the recording head, if an estimated value of the amount of the dissolved gas estimated by the dissolved gas amount estimating device exceeds a prescribed reference value.

According to the present invention, since a dissolved gas amount estimating device is provided which estimates the amount of dissolved gas contained in the liquid inside the recording head and since restoration processing of the liquid inside the recording head is carried out on the basis of the estimation results from the dissolved gas amount estimating device, it is possible to prevent discharge abnormalities caused by air bubbles forming in the ink inside the recording head, and hence a desirable discharge operation can be performed.

Furthermore, it is not necessary to provide a measuring device (dissolved oxygen meter, or the like) for measuring the amount of dissolved gas, and consequently, the device can be made more compact.

Moreover, "recording medium" represents a medium onto which liquid droplets are discharged from a recording head, and more specifically, this term includes various types of media, irrespective of material and size, such as continuous paper, cut paper, sealed paper or other types of paper, resin sheets, such as OHP sheets, film, cloth, and other materials.

Furthermore, the liquid represents various types of liquids which may be discharged from discharge holes, such as water, a chemical, processing liquid, ink, or the like.

In one mode for estimating the amount of dissolved gas contained in the liquid by means of the dissolved gas amount estimating device, the amount of dissolved gas is determined on the basis of the gas dissolution rate in the liquid flow path and the flow rate of the liquid inside the liquid flow path.

The restoration processing carried out by the liquid restoring device may include a mode where deaeration is performed in order to remove the dissolved gas from the liquid inside the recording head by means of a deaerating device, such as a deaerator, or a mode where the liquid is purged by discharging or expelling the liquid from discharge holes provided in the recording head, or the liquid inside the recording head is suctioned by means of a suction device, such as a pump, whereupon new liquid is supplied to the interior of the recording head.

Desirably, if the estimated value of the amount of dissolved gas exceeds a reference value during printing, then the printing operation is halted and restoration processing is carried out.

Preferably, the image forming apparatus further comprises: a dissolved gas amount measuring device which measures an amount of the dissolved gas contained in the liquid supplied to the recording head, the dissolved gas amount measuring device being disposed on an upstream side of the recording head with respect to a flow direction of the liquid, wherein the liquid restoring device carries out the restoration processing of the liquid inside the recording head, if a measured value of the amount of the dissolved gas measured by the dissolved gas amount measuring device exceeds the reference value.

According to the present invention, the dissolved gas amount measuring device that measures the amount of the dissolved gas contained in the liquid is provided on the upstream side of the recording head with respect to the flow direction of the liquid, and if the dissolved gas amount measured by this dissolved gas amount measuring device exceeds a reference value, then restoration processing of the ink inside the recording head is carried out.

Since the amount of dissolved gas in the liquid in the vicinity of the recording head can be measured by the dissolved gas amount measuring device, it is possible to determine abnormalities in the liquid restoring device, and it is also possible to ascertain the amount of dissolved gas in the liquid, accurately. Furthermore, the dissolved gas amount measuring device may include a dissolved oxygen meter for measuring the amount of oxygen dissolved in the liquid.

In other words, if a dissolved gas amount measuring device for measuring the actual amount of dissolved gas is provided on the upstream side of the recording head, then restoration processing of the liquid is carried out in cases where an estimated value based on this dissolved gas amount measurement exceeds a reference value.

Preferably, the image forming apparatus further comprises: a dissolved gas amount measuring device which measures an amount of the dissolved gas contained in the liquid sent from the recording head, the dissolved gas amount measuring device being disposed on a downstream side of the recording head with respect to a flow direction of the liquid, wherein, if the estimated value does not exceed the reference value, the liquid restoring device does not carry out restoration processing of the liquid inside the recording head even in cases where a measured value of the amount of the dissolved gas measured by the dissolved gas amount measuring device does exceed the reference value.

According to the present invention, if the dissolved gas amount estimated by the dissolved gas amount estimating device does not exceed the reference value, even in cases where the measurement value of the dissolved gas amount measuring device does exceed the reference value, restoration processing of the liquid inside the recording head is not carried out, and consequently, the liquid is not consumed wastefully.

Preferably, the liquid restoring device includes a deaerating device which removes at least a portion of the dissolved gas contained in the liquid inside the recording head. According to this, since the deaerating device is provided for removing the dissolved gas contained in the liquid, the liquid supplied to the recording head is subjected to prescribed deaeration processing.

The deaerating device is preferably disposed on the upstream side of the recording head with respect to the flow of the liquid, in order to carry out deaeration processing of the liquid supplied to the recording head. Furthermore, desirably, the distance between the deaerating device and the recording head is shortened.

Preferably, the liquid restoring device includes a liquid expelling device which expels the liquid inside the recording head to outside of the recording head through discharge holes provided in the recording head. According to this, since liquid having a dissolved gas content exceeding the reference value is expelled to the outside of the recording head, it is possible to supply new liquid to the recording head.

It is also possible to combine the expulsion of the liquid by the expelling device and the deaeration processing by the deaerating device.

Modes for expelling the liquid to the outside of the recording head include a mode where the liquid is purged by discharging the liquid from the recording head onto a maintenance member, such as a cap (preliminary discharge, blank discharge dummy discharge, or the like), or a mode where the liquid inside the recording head is suctioned by means of a suction device, such as a pump.

Preferably, the image forming apparatus further comprises: a liquid supply device which stores the liquid supplied to the recording head; a dissolved gas amount measuring device which measures an amount of the dissolved gas contained in the liquid sent from the recording head, the dissolved gas amount measuring device being disposed on a downstream side of the recording head with respect to a flow direction of the liquid; and a circulation path provided with the dissolved gas amount measuring device, the liquid circulating from the recording head through the circulation path to the liquid supply device, wherein: the liquid restoring device includes a deaerating device which removes at least a portion of the dissolved gas contained in the liquid, the deaerating device being disposed on a downstream side of the liquid supply device with respect to the flow direction of the liquid; and if the estimated value exceeds the reference value, then the liquid restoring device circulates the liquid inside the recording head to the liquid supply device through the circulation path, and carries out deaeration processing of the liquid supplied to the recording head using the deaerating device in such a manner that a measured value of the amount of the dissolved gas measured by the dissolved gas amount measuring device becomes equal to or less than the reference value.

According to the present invention, if the amount of the dissolved gas contained in the liquid inside the recording head exceeds the reference value, then the liquid inside the recording head is circulated through the circulation path and the liquid supplied to the recording head is subjected to deaeration processing. Therefore, no wastage of the liquid occurs.

Furthermore, since the dissolved gas amount measuring device is positioned on the downstream side of the recording head with respect to the flow direction of the liquid, and since the amount of dissolved gas in the liquid sent from the recording head can be measured, then provided that deaeration processing is carried out in such a manner that the measurement value becomes equal to or less than the reference value, the amount of dissolved gas in the liquid inside the recording head will never exceed the reference value.

Preferably, the image forming apparatus further comprises: a liquid supply device which stores the liquid supplied to the recording head; and a dissolved gas amount measuring device which measures an amount of the dissolved gas contained in the liquid supplied to the recording head, wherein: the liquid restoring device includes a liquid expelling device which expels the liquid inside the recording head to outside of the recording head through discharge holes provided in the recording head, and a deaerating device which removes at least a portion of the dissolved gas contained in the liquid, the deaerating device being disposed on a downstream side of the liquid supply device with respect to the flow direction of the liquid; the dissolved gas amount measuring device is disposed on a downstream side of the deaerating device with respect to the flow direction of the liquid; the recording head is disposed on a downstream side of the dissolved gas amount measuring device with respect to the flow direction of the liquid; and if the estimated value exceeds the reference value, then the liquid restoring device expels the liquid inside the recording head to the outside of the recording head by means of the liquid expelling device, measures the amount of the dissolved gas contained in the liquid supplied from the liquid supply device to the recording head by the dissolved gas amount measuring device, and carries out deaeration processing using the deaerating device in such a manner that a measured value of the amount of the dissolved gas measured by the dissolved gas amount measuring device becomes equal to or less than the reference value.

If a device for measuring the amount of dissolved gas is provided on the downstream side of the recording head, then restoration processing of the liquid inside the print head is carried out on the basis of the estimated value of the dissolved gas amount estimated by the dissolved gas amount estimating device.

Preferably, the image forming apparatus further comprises: a recording head temperature adjusting device which adjusts a maintenance temperature of the recording head; and a recording head temperature adjustment control device which implements control in such a manner that the maintenance temperature of the recording head is lowered using the recording head temperature adjustment device, if the estimated value has approached the reference value. According to this, since control is implemented in such a manner that the maintenance temperature of the recording head is lowered before the amount of dissolved gas in the liquid inside the recording head reaches the reference value, then it is possible to suppress the occurrence of air bubbles in the liquid inside the recording head.

Preferably, the dissolved gas amount estimating device estimates the amount of the dissolved gas contained in the liquid according to a travel time of the liquid moving along a liquid flow path. The travel time of the liquid can be calculated on the basis of the composition of the liquid flow path (such as the length of the flow path and the number of joints in the flow path), the discharge amount and discharge period of the liquid discharged from the recording head, the amount of liquid consumed, the use frequency of the recording head, and the like.

Moreover, in order to attain the aforementioned object, the present invention is also directed to a liquid control method for an image forming apparatus including a recording head which discharges droplets of liquid onto a recording medium, the method comprising the steps of: estimating an amount of dissolved gas contained in the liquid inside the recording head; and carrying out restoration processing of the liquid inside the recording head, if an estimated value of the amount of the dissolved gas estimated in the estimating step exceeds a prescribed reference value.

According to the present invention, a dissolved gas amount estimating device is provided which estimates the amount of dissolved gas contained in the liquid inside the recording head, and if the estimated amount of dissolved gas exceeds a prescribed reference value, then restoration processing of the liquid, such as deaeration processing or purging, is carried out with respect to the liquid inside the recording head. Consequently, the amount of dissolved gas in the liquid inside the recording head is controlled in such a manner that it becomes equal to or less than the reference value, and therefore, it is possible to suppress the occurrence of air bubbles in the liquid inside the recording head and to prevent discharge abnormalities caused by the occurrence of air bubbles.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Configuration of an Inkjet Recording Apparatus

Figure 1:
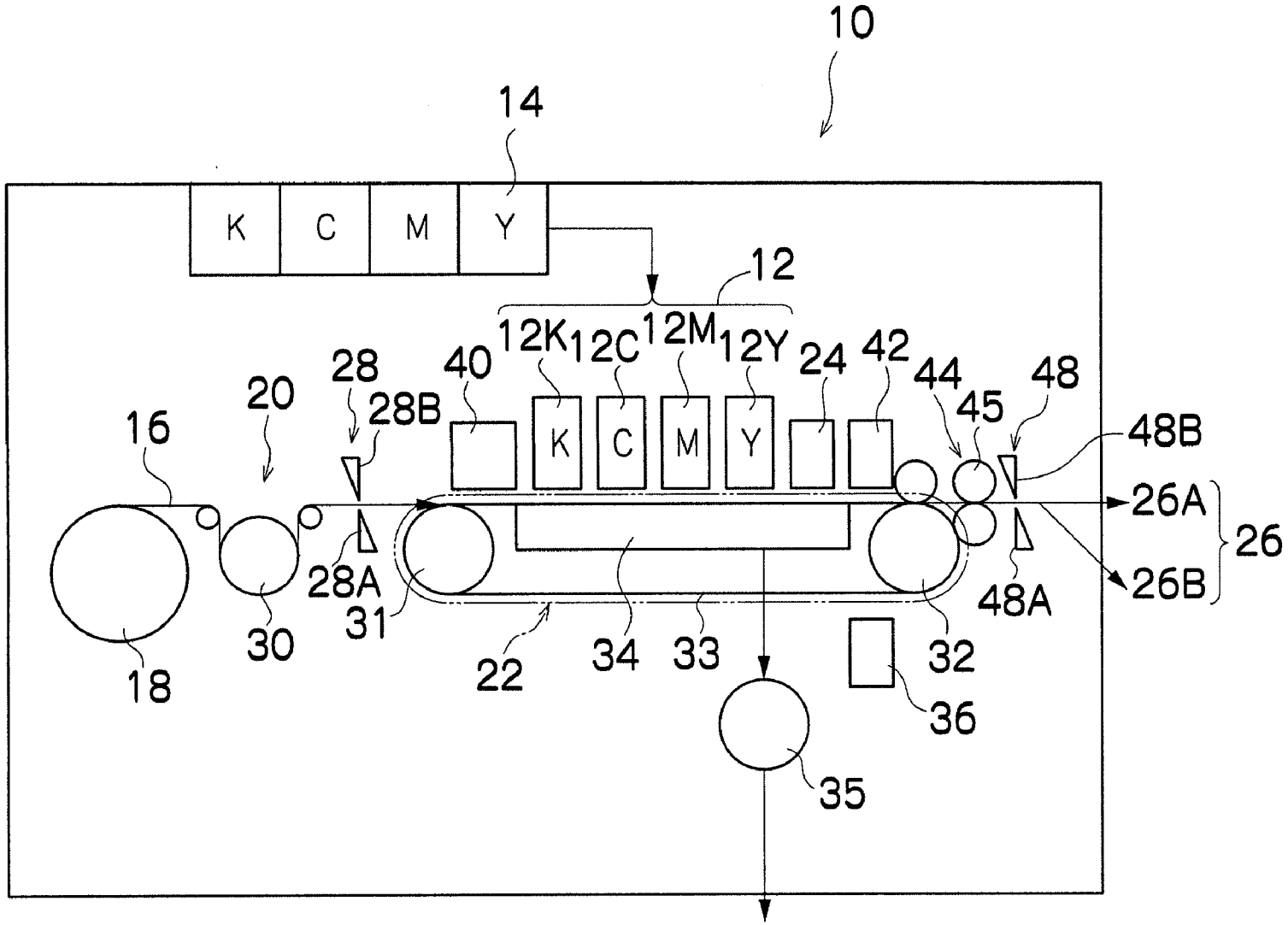
FIG. 1 is a general schematic drawing of an inkjet recording apparatus according to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing/loading unit 14 for storing inks to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is equal to or greater than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction. The belt 33 is driven in the clockwise direction in FIG. 1 by the motive force of a motor (not shown in FIG. 1, but shown as a motor 88 in FIG. 7) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not depicted, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
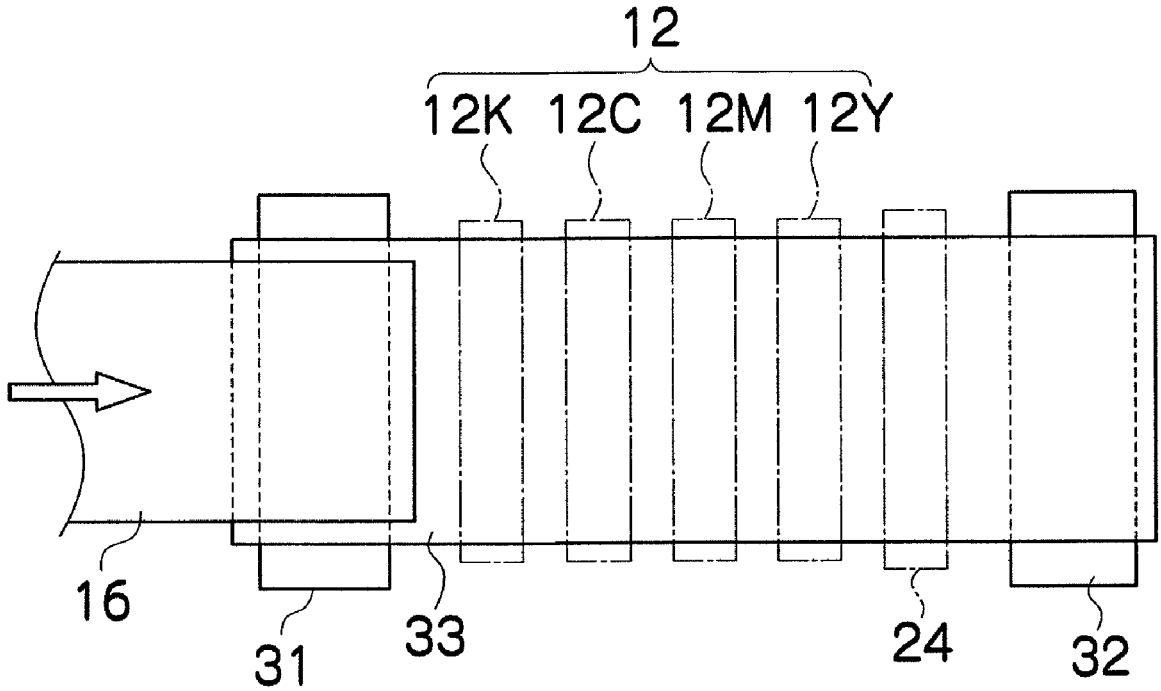
FIG. 2 is a plan view of principal components of an area around a printing unit of inkjet recording apparatus in FIG. 1.

As shown in FIG. 2, the printing unit 12 forms a so-called fill-line head in which a line head having a length that corresponds to the maximum paper width is disposed in the main scanning direction perpendicular to the delivering direction of the recording paper 16 (hereinafter referred to as the paper conveyance direction) represented by the arrow in FIG. 2, which is substantially perpendicular to a width direction of the recording paper 16. A specific structural example is described later, each of the print heads 12K, 12C, 12M, and 12Y is composed of a line head, in which a plurality of ink-droplet ejection apertures (nozzles) are disposed along a length that exceeds at least one side of the maximum-size recording paper 16 intended for use in the inkjet recording apparatus 10, as shown in FIG. 2.

The print heads 12K, 12C, 12M, and 12Y are disposed in this order from the upstream side along the paper conveyance direction. A color print can be formed on the recording paper 16 by ejecting the inks from the print heads 12K, 12C, 12M, and 12Y, respectively, onto the recording paper 16 while conveying the recording paper 16.

Although the configuration with the KCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added. Moreover, a configuration is possible in which a single print head adapted to record an image in the colors of CMY or KCMY is used instead of the plurality of print heads for the respective colors.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

As shown in FIG. 1, the ink storing/loading unit 14 has tanks for storing the inks to be supplied to the print heads 12K, 12C, 12M, and 12Y, and the tanks are connected to the print heads 12K, 12C, 12M, and 12Y through channels (not shown), respectively. The ink storing/loading unit 14 has a warning device (e.g., a display device, an alarm sound generator) for warning when the remaining amount of any ink is low, and has a mechanism for preventing loading errors among the colors.

The print determination unit 24 has an image sensor for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) disposed in a line provided with an R filter, a green (G) sensor row with a G filter, and a blue (B) sensor row with a B filter. Instead of a line sensor, it is possible to use an area sensor composed of photoelectric transducing elements which are disposed two-dimensionally.

The print determination unit 24 reads a test pattern printed with the print heads 12K, 12C, 12M, and 12Y for the respective colors, and the ejection of each head is determined. The ejection determination includes the presence of the ejection, measurement of the dot size, and measurement of the dot deposition position. The print determination unit 24 is provided with a light source (not shown) to illuminate the deposited dots.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, a sorter for collecting prints according to print orders is provided to the paper output unit 26A for the target prints.

Next, the structure of the print heads is described. The print heads 12K, 12C, 12M, and 12Y provided for the ink colors have the same structure, and a reference numeral 50 is hereinafter designated to any of the print heads 12K, 12C, 12M, and 12Y.

Figure 3A:
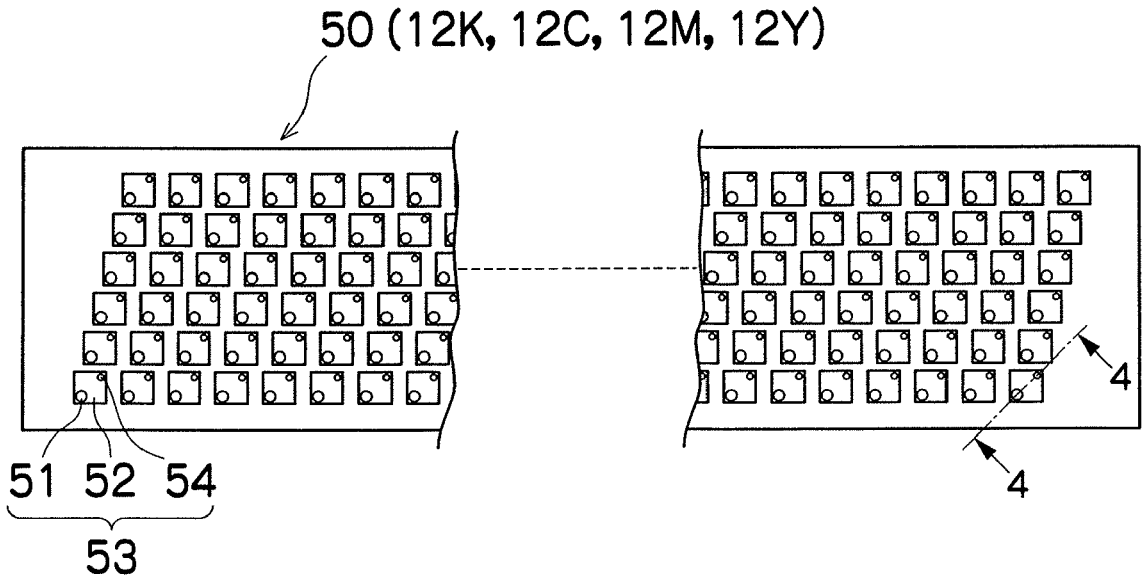
FIG. 3A is a perspective plan view showing an example of the configuration of the print head.
Figure 3B:
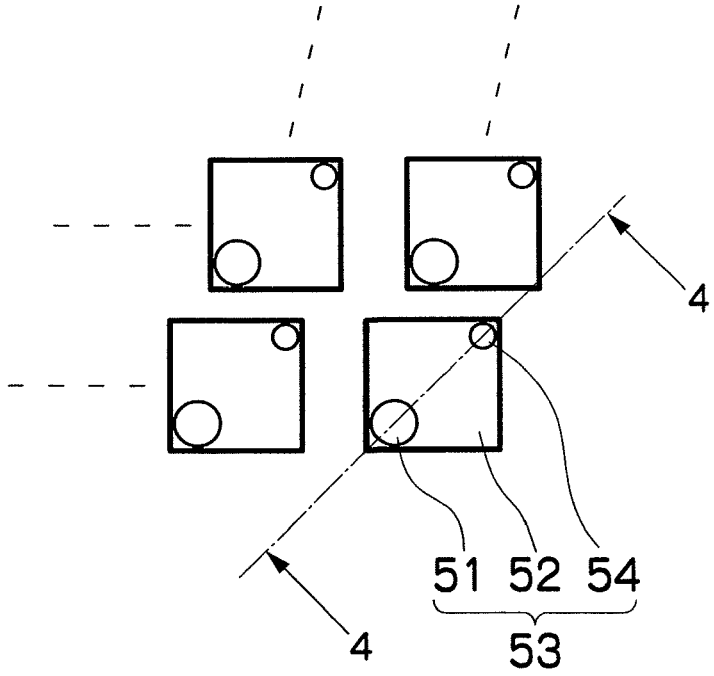
FIG. 3B is an enlarged view of a portion thereof.
Figure 3C:
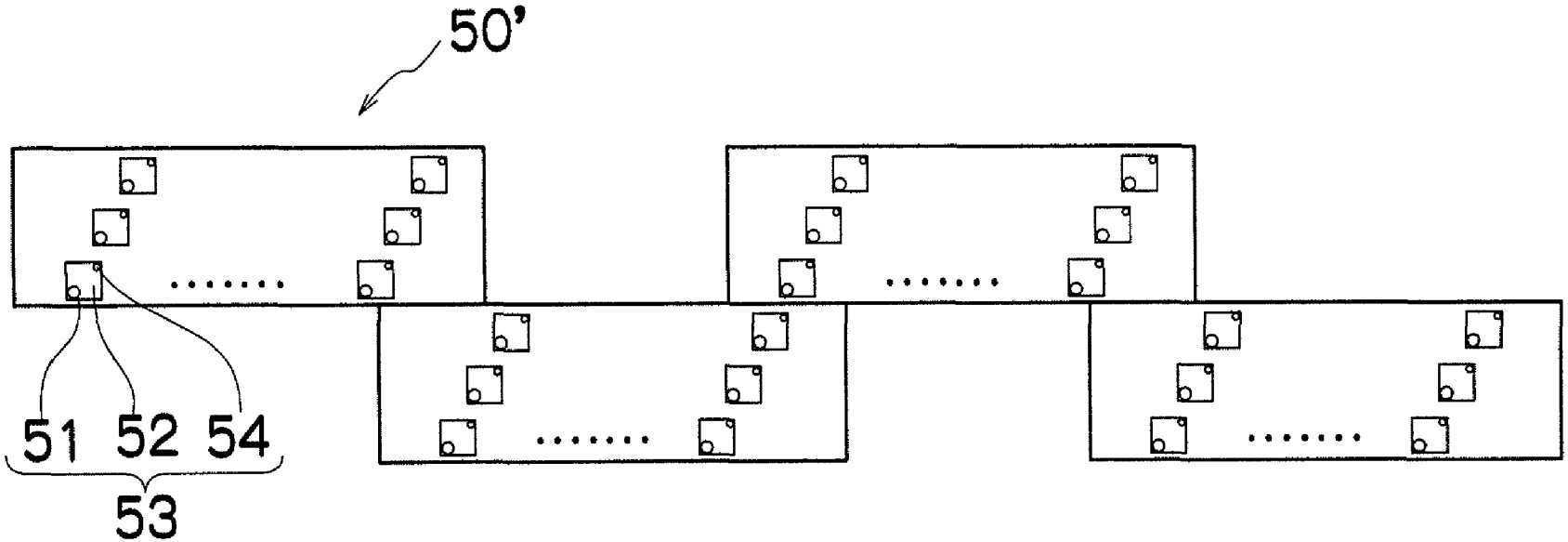
FIG. 3C is a perspective plan view showing another example of the configuration of the print head.
Figure 4:
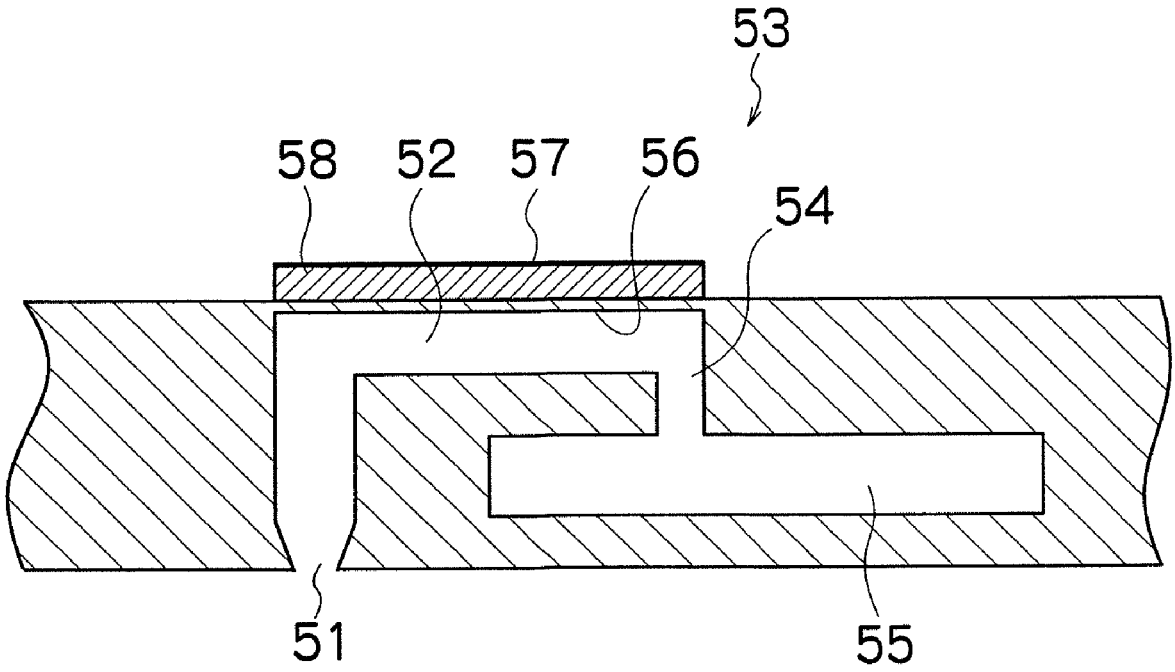
FIG. 4 is a cross-sectional view along a line 4-4 in FIGS. 3A and 3B.

FIG. 3A is a perspective plan view showing an example of a configuration of a print head, FIG. 3B is a partial enlarged view of FIG. 3A, FIG. 3C is a perspective plan view showing another example of the configuration of the print head, and FIG. 4 is a cross-sectional view taken along the line 4-4 in FIGS. 3A and 3B, showing the inner structure of an ink chamber unit. The nozzle pitch in the print head 50 should be minimized in order to maximize the density of the dots printed on the surface of the recording paper. As shown in FIGS. 3A, 3B, 3C and 4, the print head 50 in the present embodiment has a structure in which a plurality of ink chamber units 53 including nozzles 51 for ejecting ink-droplets and pressure chambers 52 connecting to the nozzles 51 are disposed in the form of a staggered matrix, and the effective nozzle pitch is thereby made small.

As shown in FIGS. 3A and 3B, the print head 50 in the present embodiment is a full-line head in which one or more of nozzle rows in which the ink discharging nozzles 51 are disposed along a length corresponding to the entire width of the recording medium in the direction substantially perpendicular to the conveyance direction of the recording medium.

Alternatively, as shown in FIG. 3C, a full-line head can be composed of a plurality of short two-dimensionally arrayed head units 50' disposed in the form of a staggered matrix and combined so as to form nozzle rows having lengths that correspond to the entire width of the recording paper 16.

The planar shape of the pressure chamber 52 provided for each nozzle 51 is substantially a square, and the nozzle 51 and an inlet of supplied ink (supply port) 54 are disposed in both corners on a diagonal line of the square. Each pressure chamber 52 is connected to a common channel (not shown) through the supply port 54.

An actuator 58 having a discrete electrode 57 is joined to a pressure plate 57, which forms the ceiling of the pressure chamber 52, and the actuator 58 is deformed by applying drive voltage to the discrete electrode 57 to eject ink from the nozzle 51. When ink is ejected, new ink is delivered from the common flow channel 55 through the supply port 54 to the pressure chamber 52.

The plurality of ink chamber units 53 having such a structure are disposed in a grid with a fixed pattern in the line-printing direction along the main scanning direction and in the diagonal-row direction forming a fixed angle θ that is not a right angle with the main scanning direction. With the structure in which the plurality of rows of ink chamber units 53 are disposed at a fixed pitch d in the direction at the angle θ with respect to the main scanning direction, the nozzle pitch P as projected in the main scanning direction is $d \times \cos\theta$.

Hence, the nozzles 51 can be regarded to be equivalent to those disposed at a fixed pitch P on a straight line along the main scanning direction. Such configuration results in a nozzle structure in which the nozzle row projected in the main scanning direction has a high nozzle density of up to 2,400 nozzles per inch (npi).

In the implementation of the present invention, the structure of the nozzle disposement is not particularly limited to the examples shown in the drawings. Moreover, the present embodiment adopts the structure that ejects ink-droplets by deforming the actuator 58 such as a piezoelectric element; however, the implementation of the present invention is not particularly limited to this. Instead of the piezoelectric inkjet method, various methods may be adopted including a thermal inkjet method in which ink is heated by a heater or another heat source to generate bubbles, and ink-droplets are ejected by the pressure thereof.

Figure 5:
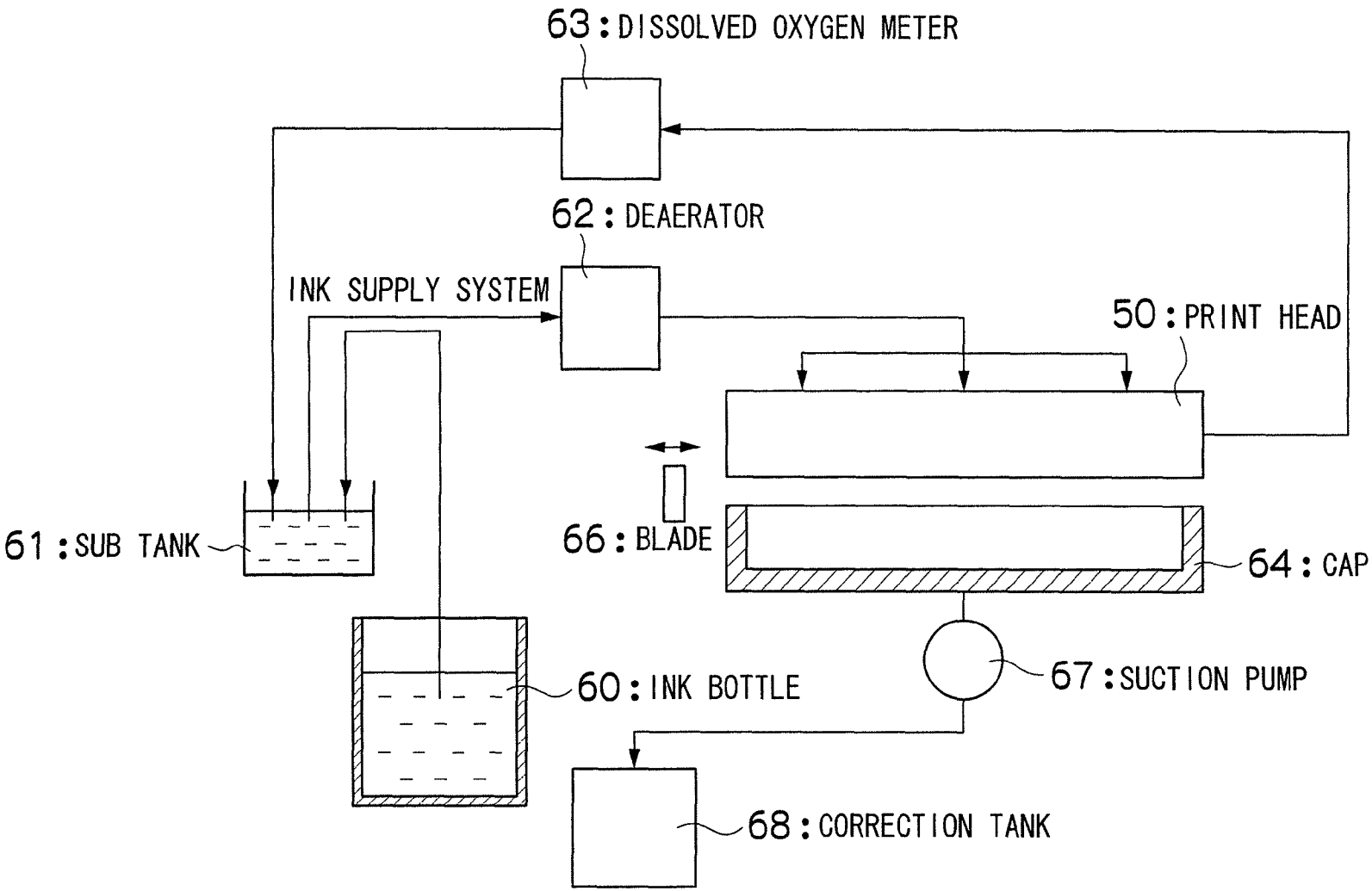
FIG. 5 is a schematic drawing showing the configuration of the ink supply system in the inkjet recording apparatus.

FIG. 5 is a schematic drawing showing the configuration of the ink supply system in the inkjet recording apparatus 10.

An ink bottle 60 is a base tank that supplies ink and is set in the ink storing/loading unit 14 described with reference to FIG. 1. The aspects of the ink bottle 60 include a refillable type and a cartridge type: when the remaining amount of ink is low, the ink bottle 60 of the refillable type is filled with ink through a filling port (not shown) and the ink bottle 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type.

As shown in FIG. 5, the ink bottle 60 is connected to a sub tank 61 via an ink supply path, and a deaerator 62 is provided between the sub tank 61 and the print head 50 in order to remove gas (air bubble) dissolved in the ink. Furthermore, a filter (not illustrated) for removing foreign matter, and the like, from the ink is provided between the sub tank 61 and the deaerator 62. The filter mesh size in the filter 62 is preferably equivalent to or less than the diameter of the nozzle and commonly about 20 μm.

The sub tank 61 has a damper function for preventing variation in the internal pressure of the head and a function for improving refilling of the print head. Possible modes for controlling the internal pressure by means of the sub tank 61 are: a mode where the internal pressure of the ink chamber unit 53 is controlled by the differential in the ink level between a sub tank which is open to the external air and the ink chamber units inside the print head 50; and a mode where the internal pressure of the sub tank and the ink chambers is controlled by a pump connected to a sealed sub tank; and the like. Either of these modes may be adopted.

Furthermore, a dissolved oxygen meter 63 is provided for measuring the amount of dissolved gas contained in the unused ink inside the print head 50, and after the amount of dissolved gas has been measured by the dissolved oxygen meter 63, the unused ink inside the print head 50 is supplied to the sub tank 61. In this way, an ink circulation channel is formed from the print head 50 to the sub tank 61 via the dissolved oxygen meter 63 (this circulation channel is not illustrated in FIG. 5 and is indicated by reference symbol 100 in FIG. 8).

The inkjet recording apparatus 10 is also provided with a cap 64 as a device to prevent the nozzle 51 from drying out or to prevent an increase in the ink viscosity in the vicinity of the nozzles, and a cleaning blade 66 as a device to clean the nozzle face. A maintenance unit including the cap 64 and the cleaning blade 66 can be moved in a relative fashion with respect to the print head 50 by a movement mechanism (not shown), and is moved from a predetermined holding position to a maintenance position below the print head 50 as required.

The cap 64 is displaced up and down in a relative fashion with respect to the print head 50 by an elevator mechanism (not shown). When the power of the inkjet recording apparatus 10 is switched OFF or when in a print standby state, the cap 64 is raised to a predetermined elevated position so as to come into close contact with the print head 50, and the nozzle face is thereby covered with the cap 64.

The cleaning blade 66 is composed of rubber or another elastic member, and can slide on the ink discharge surface (surface of the nozzle plate) of the print head 50 by means of a blade movement mechanism (not shown). When ink droplets or foreign matter has adhered to the nozzle plate, the surface of the nozzle plate is wiped, and the surface of the nozzle plate is cleaned by sliding the cleaning blade 66 on the nozzle plate.

During printing or standby, when the frequency of use of specific nozzles is reduced and ink viscosity increases in the vicinity of the nozzles, a preliminary discharge is made toward the cap 64 to discharge the degraded ink.

Also, when bubbles have become intermixed in the ink inside the print head 50 (inside the pressure chamber), the cap 64 is placed on the print head 50, ink (ink in which bubbles have become intermixed) inside the pressure chamber is removed by suction with a suction pump 67, and the suction-removed ink is sent to a collection tank 68. This suction action entails the suctioning of degraded ink whose viscosity has increased (hardened) when initially loaded into the head, or when service has started after a long period of being stopped.

When a state in which ink is not discharged from the print head 50 continues for a certain amount of time or longer, the ink solvent in the vicinity of the nozzles 51 evaporates and ink viscosity increases. In such a state, ink can no longer be discharged from the nozzle 51 even if the actuator 59 is operated. Before reaching such a state the actuator 59 is operated (in a viscosity range that allows discharge by the operation of the actuator 59), and the preliminary discharge is made toward the ink receptor to which the ink whose viscosity has increased in the vicinity of the nozzle is to be discharged. After the nozzle surface is cleaned by a wiper such as the cleaning blade 66 provided as the cleaning device for the nozzle face, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

When bubbles have become intermixed in the ink inside the nozzle 51 and the pressure chamber 52, ink can no longer be discharged from the nozzles even if the actuator 58 is operated. Also, when the ink viscosity inside the nozzle 51 has increased over a certain level, ink can no longer be discharged from the nozzle 51 even if the actuator 58 is operated. In these cases, a suctioning device to remove the ink inside the pressure chamber 52 by suction with a suction pump, or the like, is placed on the nozzle face of the print head 50, and the ink in which bubbles have become intermixed or the ink whose viscosity has increased is removed by suction.

However, this suction action is performed with respect to all the ink in the pressure chamber 52, so that the amount of ink consumption is considerable. Therefore, a preferred aspect is one in which a preliminary discharge is performed when the increase in the viscosity of the ink is small.

Figure 6:
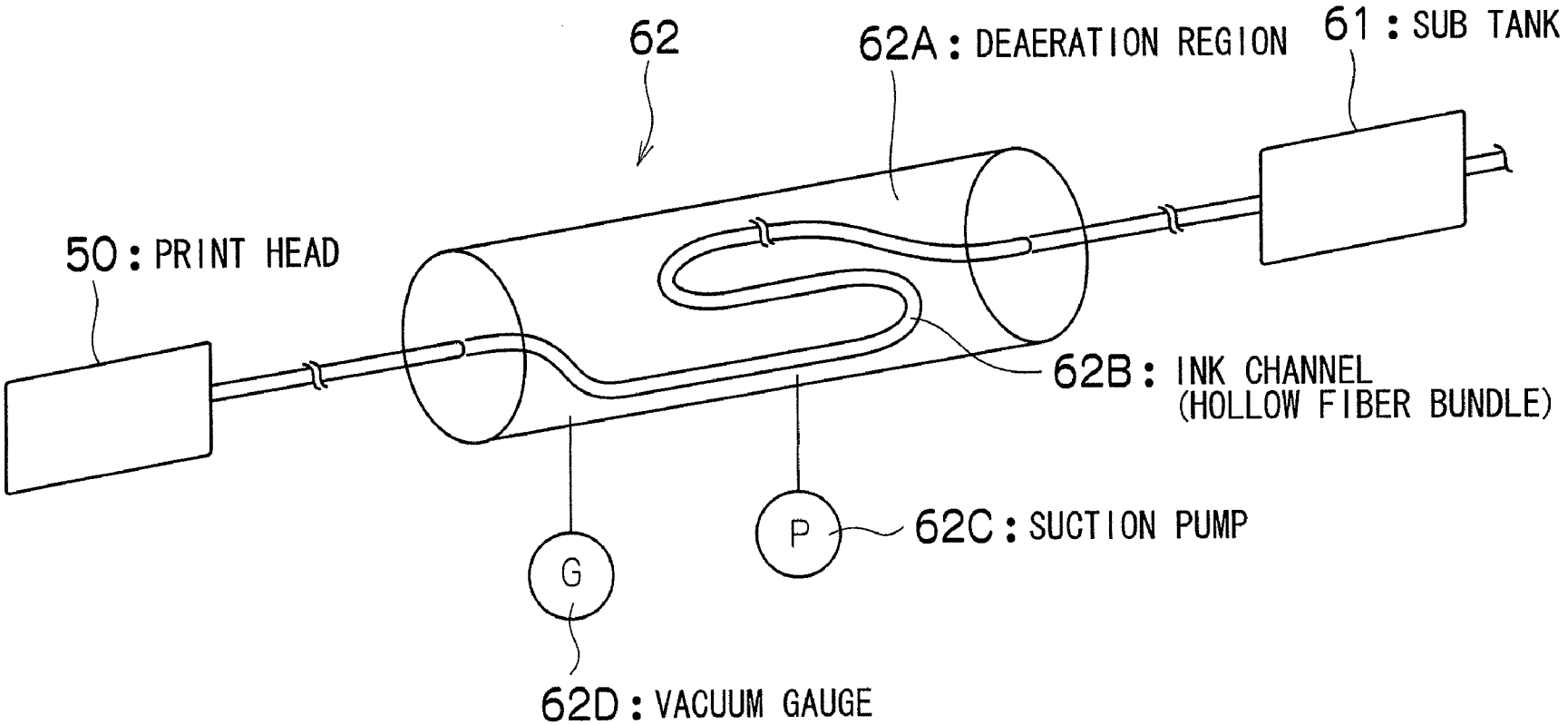
FIG. 6 is a conceptional diagram showing the composition of a deaerator in the inkjet recording apparatus.

FIG. 6 is a conceptional diagram showing the structure of the deaerator 62 illustrated in FIG. 5.

The deaerator 62 comprises an ink flow channel 62B provided with a hollow fiber bundle which is gas-permeable, such as a fluorine-based tube or silicon-based tube, in a deaerating region 62A. The ink arriving from the sub tank 61 is subjected to deaeration at reduced pressure when it passes through the ink flow channel 62B, whereupon it is supplied to the print head 50.

In the reduced pressure deaeration process, if the pressure of the deaerating region 62A is reduced by means of a vacuum pump 62C, then the gas dissolved inside the ink is removed from the ink due to the action of the negative pressure acting on the outer circumference of the ink flow channel 62B, and the separated gas is discharged into the atmosphere via the vacuum pump 62C. Moreover, the deaerator 62 also comprises a vacuum gauge 62D in order to monitor the pressure (level of vacuum) inside the deaerating region.

A commonly known technique, such as the vacuum (reduced pressure deaeration) method described above can be used for deaerating the ink in the deaerator 62, and various other methods, such as an ultrasonic vibration method or a centrifugal separation method, may also be used.

Figure 7:
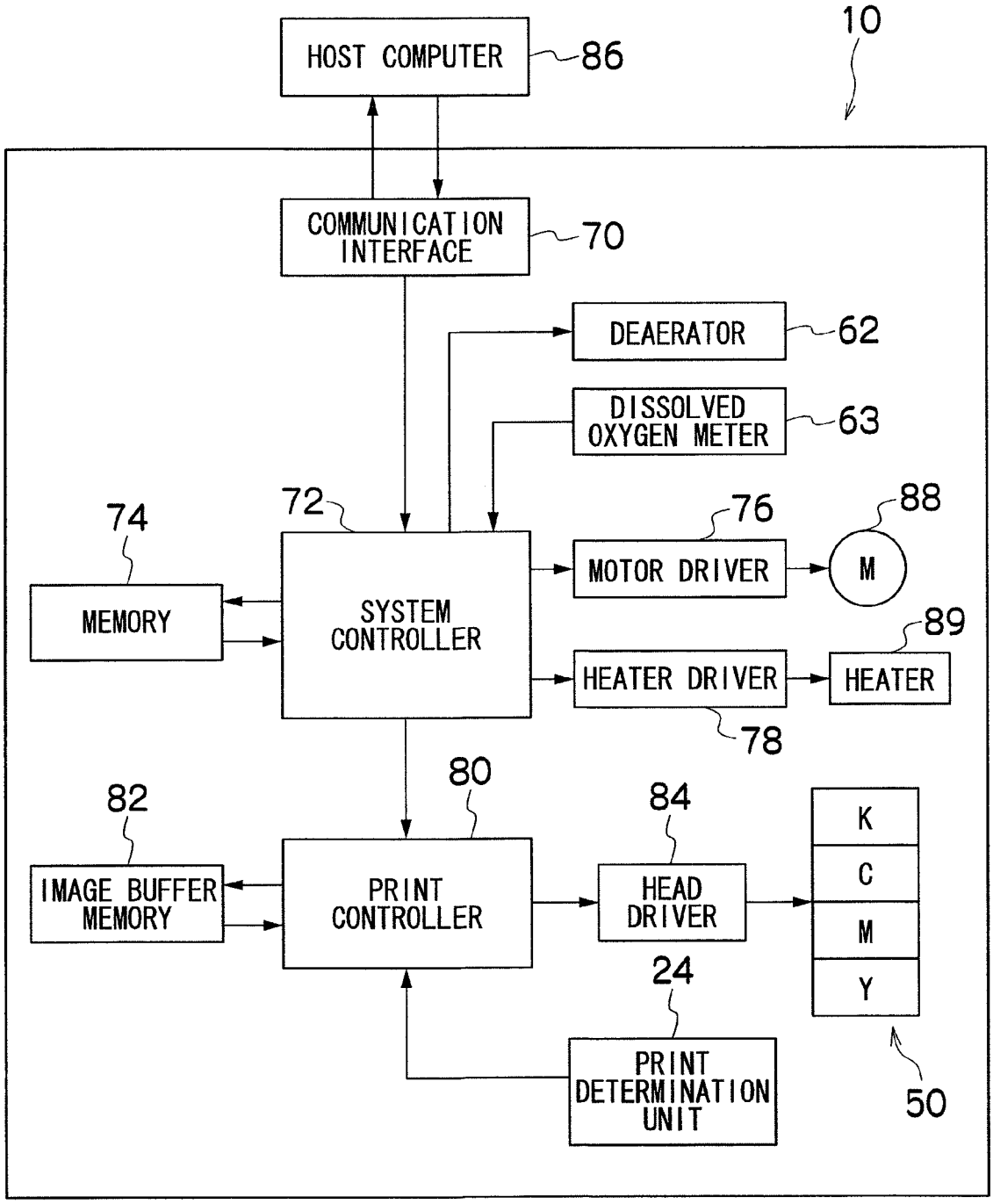
FIG. 7 is a block diagram of the principal components showing the system configuration of the inkjet recording apparatus.

FIG. 7 is a block diagram of the principal components showing the system configuration of the inkjet recording apparatus 10. The inkjet recording apparatus 10 has a communication interface 70, a system controller 72, an image memory 74, a motor driver 76, a heater driver 78, a print controller 80, an image buffer memory 82, a head driver 84, and other components.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to memory composed of a semiconductor element, and a hard disk drive or another magnetic medium may be used.

The system controller 72 controls the communication interface 70, image memory 74, motor driver 76, heater driver 78, and other components. The system controller 72 has a central processing unit (CPU), peripheral circuits therefor, and the like. The system controller 72 controls communication between itself and the host computer 86, controls reading and writing from and to the image memory 74, and performs other functions, and also generates control signals for controlling a heater 89 and the motor 88 in the conveyance system.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to apply the generated print control signals (print data) to the head driver 84. Required signal processing is performed in the print controller 80, and the ejection timing and ejection amount of the ink-droplets from the print head 50 are controlled by the head driver 84 on the basis of the image data. Desired dot sizes and dot placement can be brought about thereby.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives actuators for the print heads 12K, 12C, 12M, and 12Y of the respective colors on the basis of the print data received from the print controller 80. A feedback control system for keeping the drive conditions for the print heads constant may be included in the head driver 84.

The inkjet recording apparatus 10 comprises an ink control function whereby the amount of dissolved gas contained in the ink is equal to or less than a prescribed value. The details of this function are described below, but the amount of dissolved gas in the ink inside the print head 50 is estimated by the system controller 72, and if this estimate amount of dissolved gas exceeds a prescribed value, then the system controller 72 implements control whereby the ink inside the print head 50 is circulated to the deaerator 62, the ink is subjected to deaeration processing in the deaerator 62, and the deaerated ink is then supplied to the print head 50.

The amount of dissolved gas in the ink circulated from the print head 50 to the sub tank 61 is measured by a dissolved oxygen meter 63. This measurement result is sent to the system controller 72, which compares the amount of dissolved gas in the ink with a specified value, and if the amount of dissolved gas exceeds this specified value, then the system controller 72 activates the deaerator 62 and further deaeration of the ink is performed.

Here, the gas measured by the dissolved oxygen meter includes various other gases which may be dissolved in the ink, and not only oxygen.

First Embodiment

Next, the ink control method and deaeration process control in an inkjet recording apparatus 10 according to a first embodiment of the present invention will be described.

Generally, in an inkjet recording apparatus, there is significant loss in the pressure applied to the ink if air bubbles become mixed into the ink chamber unit 53 illustrated in FIGS. 3A to 3C and FIG. 4, and this can give rise to discharge abnormalities.

Discharge abnormalities of this kind give rise to image deterioration, such as streaking or color irregularities, in the printed image, and thus cause a marked decline in printing quality. Therefore, in order to prevent image deterioration of this kind, deaerated ink may be used in such a manner that the amount of dissolved gas in the ink is equal to or less than a specified value.

The inkjet recording apparatus 10 is composed in such a manner that the amount of dissolved gas in the ink inside the print head 50 is estimated and deaeration processing is carried out on the basis of this estimated value. Within the print head 50, it is not possible to circulate the ink in the nozzles 51 and pressure chambers 52 (in other words, the ink on the downstream side beyond the common flow channel), and therefore, desirably, the ink is expelled (discharged) to the outside of the print head 50 during the deaeration process.

Figure 8:
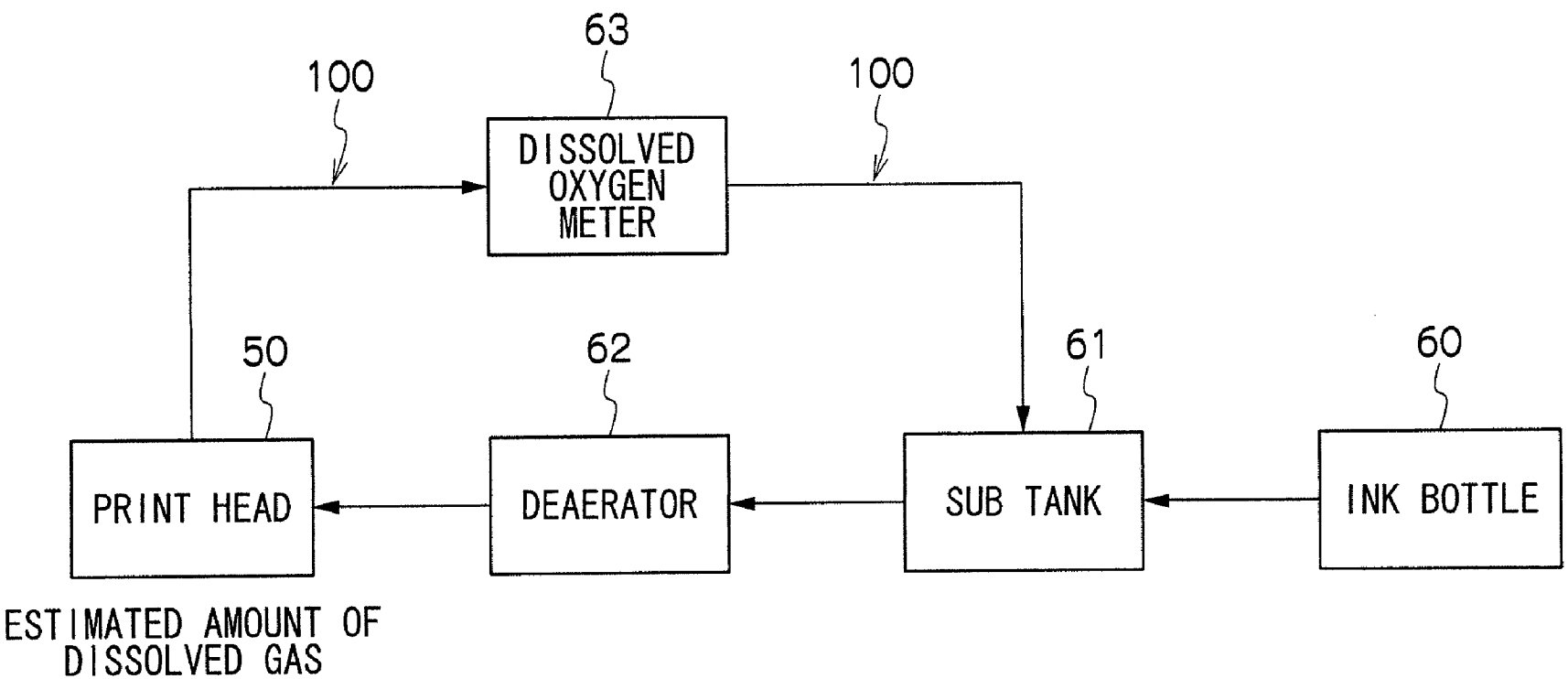
FIG. 8 is a block diagram showing the composition of an ink supply system according to the first embodiment.

FIG. 8 is a block diagram showing an isolated view of the portion of the ink supply system in the inkjet recording apparatus 10 illustrated in FIG. 5 which relates to deaeration processing. In FIG. 8, the arrows indicate the direction of the flow of ink.

As shown in FIG. 5, the ink stored in the ink bottle 60 is supplied to the print head 50 via the sub tank 61 and the deaerator 62. Furthermore, unused ink in the print head 50 is returned to the sub tank 61 by passing along a circulation channel 100 which includes a dissolved oxygen meter 63. More specifically, the ink bottle 60, sub tank 61, deaerator 62, print head 50, dissolved oxygen meter 63 and sub tank 61 are positioned, in this order, from the upstream side of the flow path. If the sub tank 61 is omitted, then a circulation channel 100 including a dissolved oxygen meter 63 is formed between the print head 50 and the ink bottle 60. Desirably, a sub tank 61 is provided in order to control the internal pressure of the print head 50 and to ensure refilling characteristics.

Furthermore, in the split type head illustrated in FIG. 3C, desirably, a deaerator 62, a dissolved oxygen meter 63 and a circulation channel 100 are provided separately in each of the split heads. If a deaerator 62, a dissolved oxygen meter 63 and a circulation channel 100 are provided in each head, then if the respective heads have different duties, it is possible to optimize the amount of dissolved gas inside each head, independently.

The amount of dissolved gas in the ink inside the print head 50 is estimate from the travel time of the ink from the deaerator 62 to the print head 50. In this estimation process, a safety ratio of 1 or more is adopted in order to ensure a suitable margin. Furthermore, it is judged whether or not to implement further deaeration of the unused ink inside the print head 50, on the basis of the measurement value from the dissolved oxygen meter 63 and the aforementioned estimate amount of dissolved gas.

The travel time of the ink can be calculated from the product of the droplet ejection size and the droplet ejection volume during printing, and the product of the droplet ejection size and droplet ejection voltage during maintenance.

The ink flow path from the deaerator 62 to the print head 50 is constituted principally by an ink supply hose and a joint for connecting this supply hose. Therefore, if the dissolution rate at which gas dissolves into the ink from outside the supply hose and the joint region is previously known, then the amount of dissolved gas contained in the ink inside the print head 50 can be estimate.

Figure 9:
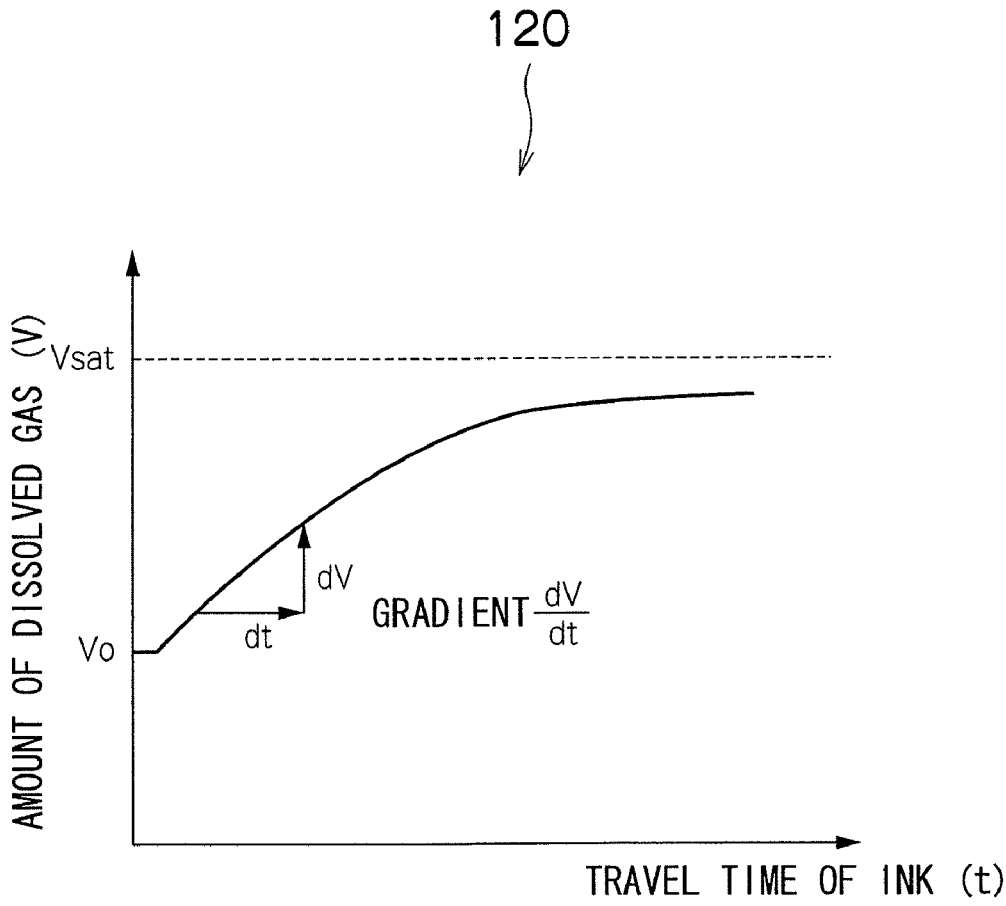
FIG. 9 is a graph showing the relationship between the amount of dissolved gas and the travel time of the ink.

More specifically, the relationship between the speed of movement of the ink, t, and the amount of dissolved gas in the ink, V, is indicated by the graph 120 shown in FIG. 9, and the gradient (dV/dt) of this graph 120 corresponds to the aforementioned dissolution rate of the gas. In the graph 120, $V_0$ is the initial value of the amount of dissolved gas, which has a different value for each type of ink. Furthermore, Vsat indicates the amount of dissolved gas at saturation, and if this amount of dissolved gas at saturation is exceeded, then air bubbles can form in the ink.

The ink dissolution rate is expressed by the following formula 1:

$$(dV/dt)=(dV/dt)_1+(dV/dt)_2+(dV/dt)_3+\ldots \quad (1)$$

This ink dissolution rate (dV/dt) varies depending on the members (joints, hose, and the like) forming the ink flow channels, and it also changes with the environmental conditions, such as temperature and humidity. Therefore, as indicated by the formula 1, the dissolution rate (dV/dt) of the gas is expressed as the sum of the gas dissolution rates $(dV/dt)_1$, $(dV/dt)_2$, $(dV/dt)_3$, . . . , derived respectively in accordance with the component members of the ink flow channels and the environmental parameters.

Figure 10:
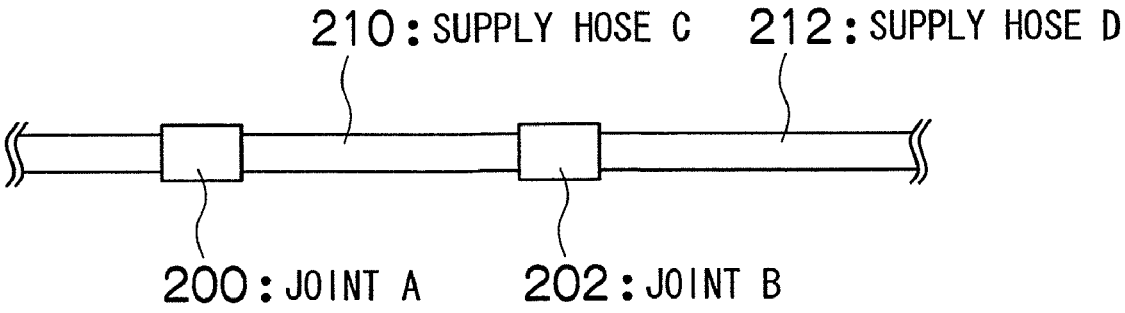
FIG. 10 is a compositional diagram showing one example of a constituent member of the ink supply system shown in FIG. 8.

In an ink supply system comprising a joint 200 (joint A), a joint 202 (joint B), a supply hose 210 (supply hose C), and a supply hose 212 (supply hose D), as shown in FIG. 10, the gas dissolution rate indicated by the formula 1 will be represented by the following formula 2:

$$(dV/dt)_1=(dV_A/dt)+(dV_B/dt)+\ldots \quad (2)$$

In other words, $(dV/dt)_1$ is the gas dissolution rate in the joint region, and its value is determined on the basis of the number of joints and the structure of each joint. If the gas dissolution rates at the joint 200 and the joint 202 are respectively taken to be $dV_A/dt$ and $dV_B/dt$, then $(dV/dt)_1$ is expressed by the sum of $dV_A/dt$ and $dV_B/dt$, as shown in the formula 2.

If there are three or more joints, then the gas dissolution rate in the joint sections $(dV/dt)_1$ , is expressed by the sum of the gas dissolution rates at each of the joints.

Furthermore, $(dV/dt)_2$ is the gas dissolution rate in the supply hose sections and is expressed by the sum of the gas dissolution rates in the hose sections as indicated by the following formula 3:

$$(dV/dt)_2=(dV_C/dt)+(dV_D/dt)+\ldots \quad (3)$$

If the gas dissolution rates in the supply hose 210 and the supply hose 212 are respectively taken to be $dV_C/dt$ and $dV_D/dt$, then $(dV/dt)_2$ is expressed by the sum of $dV_C/dt$ and $dV_D/dt$, as shown in the formula 3. Similarly to the joint sections, if there are three or more supply hoses, then the gas dissolution rate in the supply hose sections $(dV/dt)_2$ is expressed by the sum of the gas dissolution rates in each of the joints. The gas dissolution rate in the supply hoses is determined on the basis of the number of supply hoses, and the material, surface area, length, and the like, of each supply hose.

Furthermore, $(dV/dt)_3$ is the gas dissolution rate according to the gas temperature (ambient temperature).

A data table may be prepared in which the aforementioned gas dissolution rates are stored as data, this table may be stored in a memory device, such as the memory 74 or the like illustrated in FIG. 7, and the amount of dissolved gas in the ink may be estimate by referring to this data table. Alternatively, the graphs and formulae shown in FIG. 9 and FIG. 10 may be converted into a program, and the amount of dissolved gas in the ink may be estimate by means of this program.

Desirably, a non-volatile rewriteable memory, such as an EEPROM, is used as a memory device for recording the data table or the program, in such a manner that the data table or program can be updated.

If the data table or program is stored in a removable medium, such as a memory card, CD-ROM, or the like, and the data table or program is read in to the device when the power supply of the apparatus is switched on, then it is possible to refer to the most recent data table, at all times.

Figure 11:
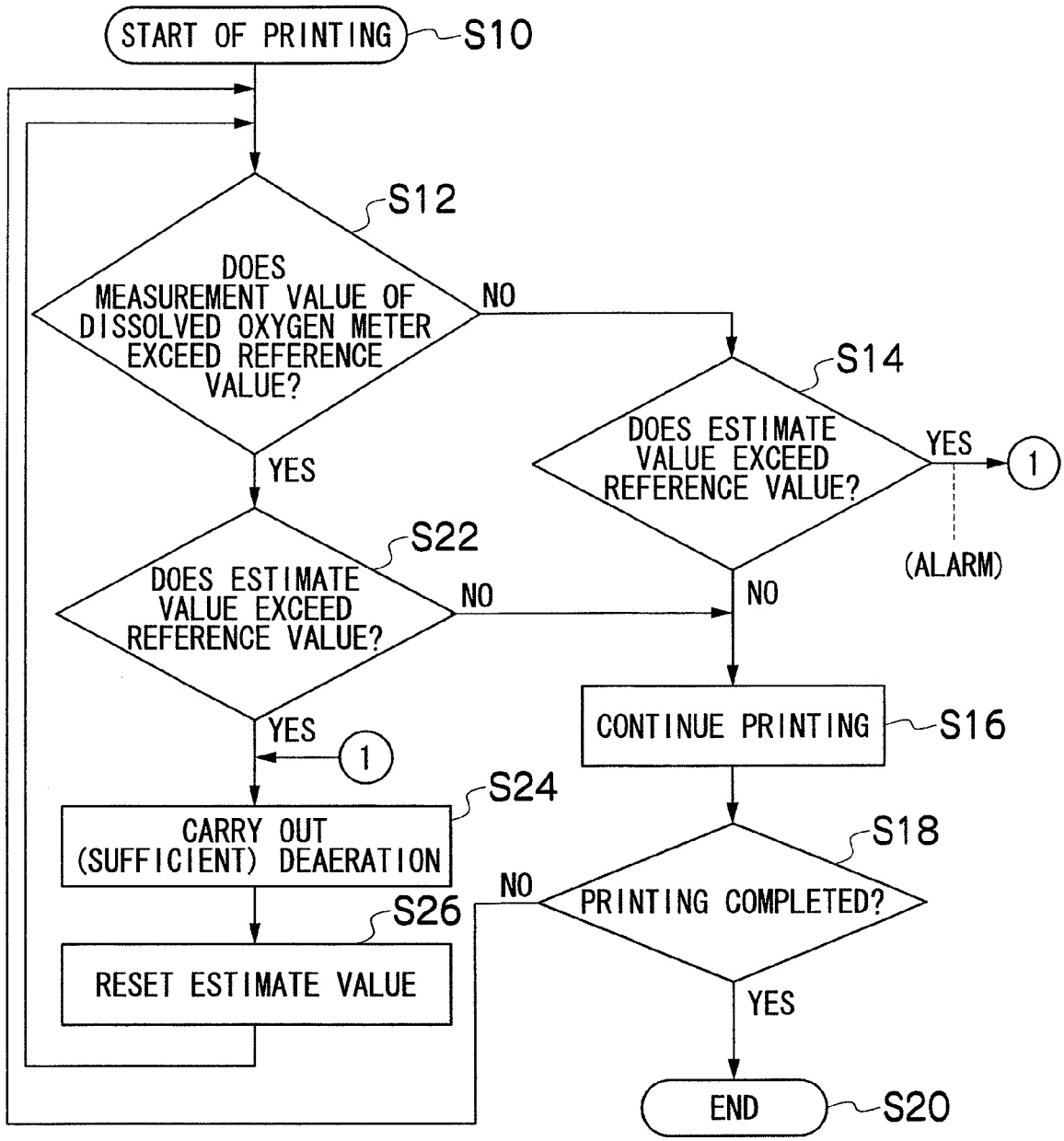
FIG. 11 is a flowchart showing a sequence of deaeration control relating to the first embodiment.

Next, the process of deaeration control in the inkjet recording apparatus 10 will be described with reference to FIG. 11. FIG. 11 is a flowchart showing the sequence of deaeration control provided in the inkjet recording apparatus 10.

When print data is acquired and printing is started (step S10), then it is judged whether or not the amount of dissolved gas in the ink measured by the dissolved oxygen meter 63 exceeds a specified value (step S12).

If the measurement value of the dissolved oxygen meter 63 does not exceed the specified value (NO verdict), then the procedure advances to step S14 and it is judged whether or not the estimate value for the amount of dissolved gas exceeds the specified value.

If it is judged at step S14 that the estimate value for the amount of dissolved gas does not exceed the specified value (NO verdict), then the procedure advances to step S16 and printing is continued.

During the printing operation, the end of printing is monitored (step S18) and if printing has not ended at step S18 (NO verdict), then the procedure returns to step S12, and the measurement value of the dissolved oxygen meter 63 is monitored.

On the other hand, if it is judged at step S18 that printing of the final print data has been completed and that a print completion operation is to be performed (YES verdict), then the printing control in the inkjet recording apparatus 10 terminates (step S20).

Furthermore, if it is judged at step S14 that the estimate value for the amount of dissolved gas exceeds the specified value (YES verdict), then printing is interrupted and the procedure advances to step S24. At step S24, the unused ink inside the print head 50 is supplied to the deaerator 62 via the circulation channel 100 shown in FIG. 8, and the ink is subjected to deaeration processing.

Thereupon, the procedure advances to step S26, where the estimate value for the amount of dissolved gas is reset, and then proceeds to step S12.

Furthermore, if it is judged at step S12 that the measurement value of the dissolved oxygen meter 63 exceeds the specified value, (YES verdict), then the procedure advances to step S22, where it is judged whether or not the estimate value for the amount of dissolved gas exceeds the specified value. If the estimate value for the amount of dissolved gas does not exceed the specified value (NO verdict), then the procedure advances to step S16 and printing is continued.

If the estimate value for the amount of dissolved gas exceeds the specified value (YES verdict) at step S22, then the procedure advances to step S24, and the unused ink inside the print head 50 is sent to the deaerator 62, where it is subjected to deaeration processing.

In other words, even in cases where the measurement value of the dissolved oxygen meter 63 exceeds the specified value, if the estimate value for the amount of dissolved gas does not exceed the specified value (in other words, if step S14 in FIG. 11 returns a NO verdict), then control is implemented in such a manner that printing continues.

If, on the other hand, the measurement value of the dissolved oxygen meter 63 exceeds the specified value and the estimate value for the amount of dissolved gas also exceeds the specified value (in other words, a YES verdict at step S22), then control is implemented in such a manner that printing is interrupted, the unused ink inside the print head 50 is returned to the deaerator 62, where it is deaerated, and printing is not restarted until the level of deaeration (the amount of dissolved gas in the ink) falls below the specified value.

Here, if the unused ink inside the print head 50 is circulated in order to deaerate the ink, then it may be impossible to discharge the ink, due to variation in the internal pressure inside the print head 50. Therefore, printing is interrupted while the ink inside the print head 50 is circulated.

Furthermore, it can be seen that a case where the estimate value for the amount of dissolved gas exceeds the specified value, when the measurement value of the dissolved oxygen meter 63 does not exceed the specified value, will not normally arise, since a safety ratio of one or above is adopted when estimating the amount of dissolved gas. In this case, there may be a possibility of a temperature change in the print head 50 and the ink supply system, and therefore control is implemented in such a manner that the ink inside the print head 50 and the ink supply system is deaerated again, and the estimate value for the amount of dissolved gas is reset.

If the same phenomenon occurs after this processing (in other words, if a YES verdict is returned again at step S22), then a fault in the dissolved oxygen meter 63 can be inferred, and hence control is implemented in such a manner that an abnormality alarm is generated.

In the ink supply system illustrated in the present example, a dissolved oxygen meter 63 is provided in the circulation channel 100 from the print head 50 to the sub tank 61, but if the deaerating capacity of the deaerator 62 is sufficiently high and the amount of dissolved gas contained in the ink falls to or below a prescribed level, then the dissolved oxygen meter 63 may be omitted.

If the dissolved oxygen meter 63 is omitted, then the amount of dissolved gas inside the print head 50 is estimate from the travel time of the ink from the deaerator 62 to the print head 50, and if this estimate value exceeds a specified value, then the unused ink inside the print head 50 is returned to the deaerator 62 and deaeration is carried out again. After further deaeration processing, if the amount of dissolved gas in the ink has fallen below a specified value, then printing is restarted.

If the dissolved oxygen meter 63 is omitted, than step S12 is omitted from the flowchart shown in FIG. 11.

In an inkjet recording apparatus 10 having the composition described above, the amount of dissolved gas in the print head 50 is estimate by a dissolved gas amount estimating device using the system controller 72, or the like, and if the amount of dissolved gas exceeds a specified value, then the ink including the unused ink inside the print head 50 is sent to the deaerator 62 via the circulation channel 100, and is subjected to deaeration processing before being supplied to the print head 50. Consequently, ink containing an amount of dissolved gas which is less than the specified value is supplied to the print head 50, and it is therefore possible to prevent discharge abnormalities caused by air bubbles forming in the ink. Furthermore, since maintenance operations, such as purging, suction, and the like, can be reduced, there is no occurrence of wasted ink that is consumed during maintenance.

Furthermore, if a dissolved oxygen meter 63 is provided in the circulation channel 100 from the print head 50 to the sub tank 61 (in other words, on the downstream side of the print head 50), then it is possible to measure, and hence judge, the amount of dissolved gas in the ink inside the print head 50. If the deaeration capacity of the deaerator is sufficiently greater than the maximum flow rate of the ink, then the amount of dissolved gas in the ink that has passed through the deaerator 62 will assume a certain, uniform saturated state. Consequently, there is no particular requirement to provide a dissolved oxygen meter 63 and control can be implemented on the basis of an estimate value for the amount of dissolved gas. If no dissolved oxygen meter 63 is provided, then a problem arises in that it is not possible to identify an abnormality in the deaerator (for instance, if the capacity of the vacuum pump is insufficient and the ink does not reach the required level of deaeration).

Even if a circulating system including a circulation channel 100 is provided, it is not possible to circulate the ink inside the nozzles 51 and the pressure chambers 52 shown in FIG. 4, and therefore purging or suction should be carried out when the ink is circulated for the purpose of further deaeration.

Second Embodiment

Next, the ink control method and deaeration process control in an inkjet recording apparatus 10 according to a second embodiment of the present invention will be described.

Figure 12:
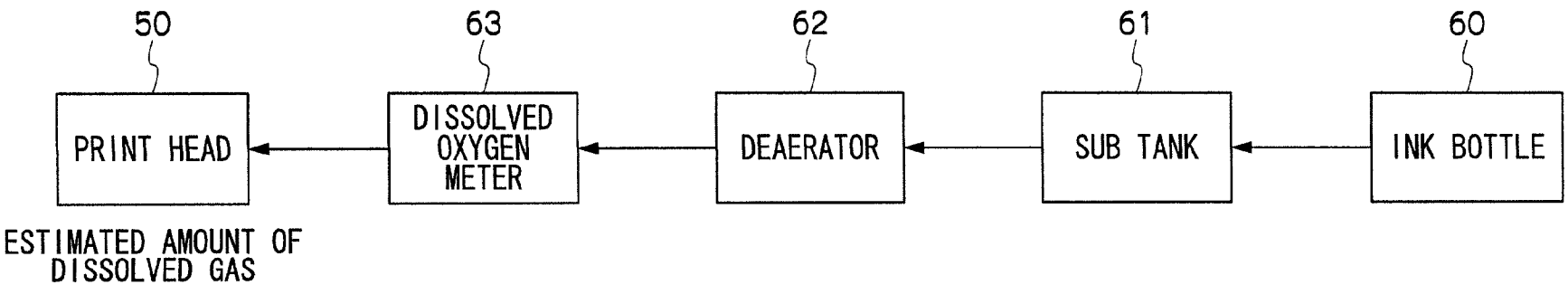
FIG. 12 is a block diagram showing the composition of an ink supply system according to the second embodiment.

FIG. 12 shows the general configuration of the ink supply system of an inkjet recording apparatus 10 relating to the second embodiment. In FIG. 12, items which are the same as or similar to those in FIG. 8 are labeled with the same reference numerals and description thereof is omitted here.

As shown in FIG. 12, the ink supply system comprises an ink bottle 60, sub tank 61, deaerator 62, dissolved oxygen meter 63 and print head 50, disposed in this order from the upstream side of the ink flow path. In other words, compared to the ink supply system shown in FIG. 8, the dissolved oxygen meter 63 is positioned on the upstream side of the print head 50, and the circulation channel 100 is omitted.

Figure 13:
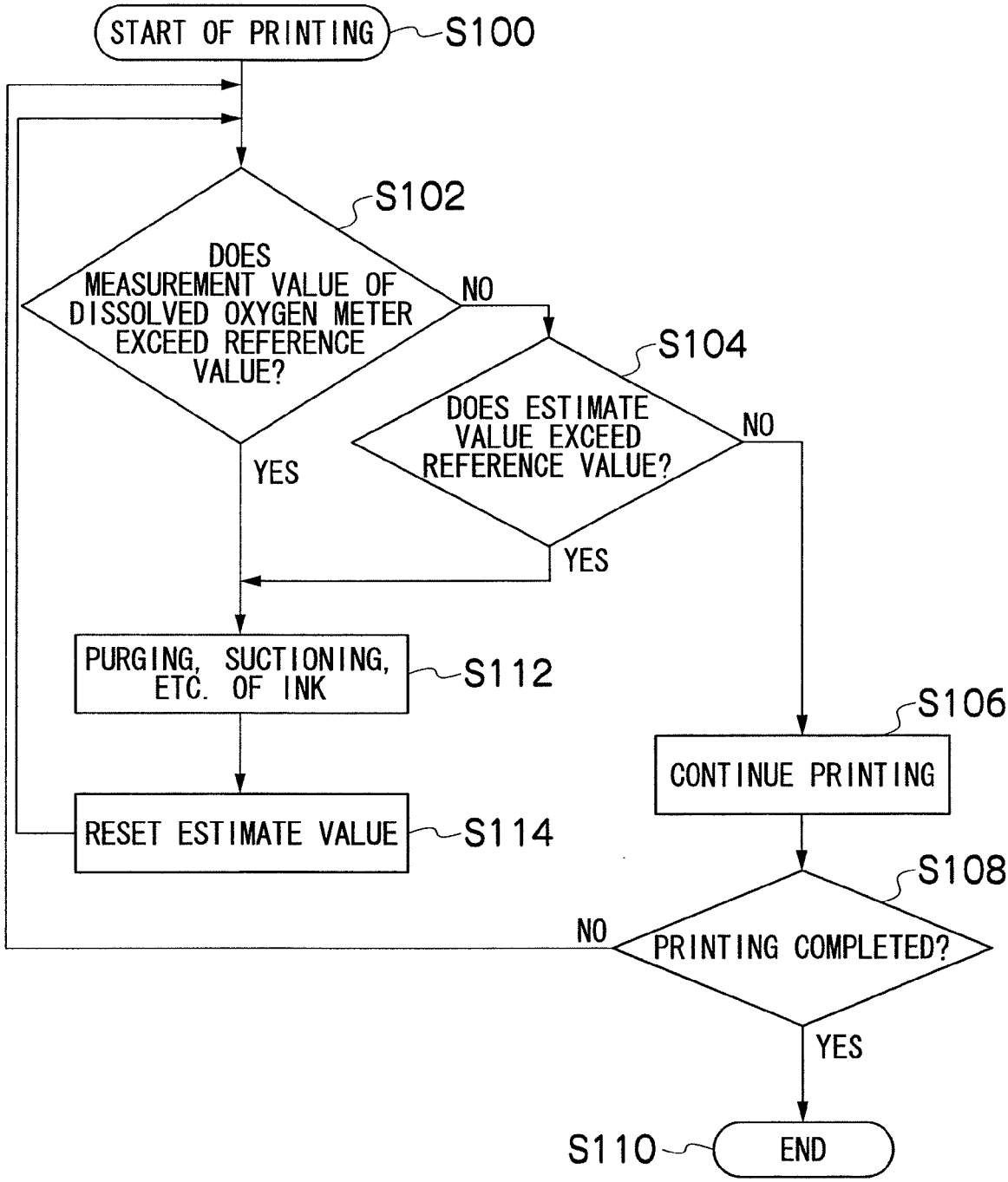
FIG. 13 is a flowchart showing a sequence of deaeration control relating to the second embodiment.

FIG. 13 is a flowchart showing the sequence of deaeration control in an inkjet recording apparatus 10 having the ink supply system shown in FIG. 12.

When print data is acquired and printing is started (step S100), then it is judged whether or not the amount of dissolved gas in the ink measured by the dissolved oxygen meter 63 exceeds a specified value (step S102).

If the measurement value of the dissolved oxygen meter 63 does not exceed the specified value (NO verdict), then it is judged whether or not the estimate value for the amount of dissolved gas exceeds the specified value (step S104).

If the estimate value for the amount of dissolved gas does not exceed the specified value in step S104 (NO verdict), then the procedure advances to step 106, printing is continued, and the end of printing is monitored (step S108). If printing has not ended in step S108 (NO verdict), then the procedure returns to step S102 and the measurement value of the dissolved oxygen meter 63 is monitored.

On the other hand, if it is judged at step S108 that printing of the final print data has been completed and that a print completion operation is to be performed (YES verdict), then the printing control in the inkjet recording apparatus 10 terminates (step S110).

Furthermore, if it is judged at step S104 that the estimate value for the amount of dissolved gas exceeds the specified value (YES verdict), then printing is interrupted, the procedure advances to step S112, and restoration processing, such as purging or suction, is carried out in the print head 50.

Thereupon, the estimate value for the amount of dissolved gas is reset (step S114), and the procedure advances to step 102.

If, on the other hand, it is judged at step S102 that the estimate value for the amount of dissolved gas exceeds the specified value (YES verdict), then the procedure advances to step S112, and restoration processing, such as purging or suction, is carried out in the print head 50.

In other words, if the measurement value of the dissolved oxygen meter 63 exceeds the specified value (namely, in the case of a YES verdict at step S102 in FIG. 13), control is implemented in such a manner that printing is interrupted and restoration processing, such as purging or suction, is carried out in the print head 50.

Furthermore, if the measurement value of the dissolved oxygen meter 63 does not exceed the specified value and the estimate value for the amount of dissolved gas does exceed the specified value (namely, in the case of a YES verdict at step S104 in FIG. 13), then control is implemented in such a manner that printing is interrupted and restoration processing, such as purging or suction, is carried out in the print head 50. The restoration processing is carried out continuously until the amount of dissolved gas has fallen to or below the specified value.

If, on the other hand, the measurement value of the dissolved oxygen meter 63 does not exceed the specified value and the estimate value of the amount of dissolved gas does not exceed the specified value either (in other words, a NO verdict at step S104), then normal printing is continued.

In the present example, it is possible to omit the dissolved oxygen meter 63. In this case, if the estimate value for the amount of dissolved gas has exceeded the specified value, then printing is interrupted, restoration processing, such as purging or suction, is carried out, and if the estimate value for the amount of dissolved gas does not exceed the specified value, then normal printing is continued. This mode may also be applied in a case where a dissolved oxygen meter 63, when a fault has occurred in the dissolved oxygen meter 63.

In the present example, it is possible to adopt a mode in which the deaerator is omitted. More specifically, since there is no circulation channel from the print head 50 to the sub tank 61 in the ink supply system shown in FIG. 12, then it is not possible to circulate the unused ink inside the print head 50 and carry out further deaeration. In other words, if the measurement value of the amount of dissolved gas exceeds the specified value, then since the ink inside the print head 50 can only be expelled to outside the print head, it is possible to omit the deaerator 62 if sufficiently deaerated ink is used. However, even if a deaerator 62 is not used, it is possible to dispose a dissolved oxygen meter inside the ink flow channel in such a manner that the amount of dissolved gas inside the print head 50 can be estimate.

In the first embodiment and second embodiment described above, if the estimate value for the amount of dissolved gas approaches the specified value, then the formation of air bubbles can be prevented by lowering the maintenance temperature of the print head 50. In general, the lower the temperature of a liquid, the greater the amount of gas that can be dissolved in that liquid.

Furthermore, it is preferable to shorten the interval at which discharge failure detection is performed, since this reduces the possibility of a printing defect occurring due to a discharge abnormality.

FIG. 11 and FIG. 13 show examples of deaeration control during a printing operation, but this control sequence may also be applied during intervals between prints, or when the apparatus is at standby.

In the above-described embodiments, a line head type of print head has been described, which corresponds to the full width of the recording medium, but the present invention may also be applied to a serial type print head which performs printing by scanning a short print head in the breadthways direction of the recording medium.

Furthermore, an ink discharge method has been described in which a discharge force is applied to the ink by driving a piezoelectric element, but it is also possible to adopt a bubble jet method in which the ink is heated by a heat source, such as a heating element, thereby generating a bubble in the ink which applies a discharge force to the ink.

The present invention may also be applied to a liquid discharge device other than an inkjet recording apparatus, such as a device for discharging a liquid such as water, processing liquid, or chemical, onto a discharge receiving medium from nozzles provided in a discharging head.

The ink control method and the deaeration control method described in the present embodiments may also be converted into programs and recorded onto a recording device, such as an internal memory or memory card. Furthermore, a recording medium on which the aforementioned programs are recorded may be distributed.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus comprising:

a recording head which discharges droplets of liquid onto a recording medium;

a dissolved gas amount calculating device which calculates an estimate of an amount of dissolved gas contained in the liquid located inside the recording head, wherein said calculation is based on properties of the liquid or properties of the image forming apparatus;

a liquid restoring device which carries out restoration processing of the liquid located inside the recording head, if the estimate of the amount of the dissolved gas calculated by the dissolved gas amount calculating device exceeds a prescribed reference value; and a dissolved gas amount measuring device which takes a measurement of an amount of the dissolved gas contained in the liquid sent from the recording head, the dissolved gas amount measuring device being disposed on a downstream side of the recording head with respect to a flow direction of the liquid, wherein, if the estimate of the amount of the dissolved gas calculated by the dissolved gas amount calculating device does not exceed the reference value, the liquid restoring device does not carry out restoration processing of the liquid located inside the recording head even in cases where the measurement of the amount of the dissolved gas taken by the dissolved gas amount measuring device does exceed the reference value.

2. The image forming apparatus as defined in claim 1, wherein the liquid restoring device includes a liquid expelling device which expels the liquid located inside the recording head to outside of the recording head through discharge holes provided in the recording head.

3. The image forming apparatus as defined in claim 1, further comprising:

a liquid supply device which stores the liquid supplied to the recording head; and a circulation path provided with the dissolved gas amount measuring device, the liquid circulating from the recording head through the circulation path to the liquid supply device, wherein:

the liquid restoring device includes a deaerating device which removes at least a portion of the dissolved gas contained in the liquid, the deaerating device being disposed on a downstream side of the liquid supply device with respect to the flow direction of the liquid; and if the estimate of the amount of the dissolved gas calculated by the dissolved gas amount calculating device exceeds the reference value, then the liquid restoring device circulates the liquid located inside the recording head to the liquid supply device through the circulation path, and carries out deaeration processing of the liquid supplied to the recording head using the deaerating device in such a manner that the measurement of the amount of the dissolved gas taken by the dissolved gas amount measuring device becomes equal to or less than the reference value.

4. The image forming apparatus as defined in claim 1, further comprising:

a recording head temperature adjusting device which adjusts a maintenance temperature of the recording head; and a recording head temperature adjustment control device which implements control in such a manner that the maintenance temperature of the recording head is lowered using the recording head temperature adjustment device, if the estimate of the amount of the dissolved gas calculated by the dissolved gas amount calculating device has approached the reference value.

5. The image forming apparatus as defined in claim 1, wherein the dissolved gas amount calculating device calculates the estimate of the amount of the dissolved gas contained in the liquid according to a travel time of the liquid moving along a liquid flow path.

6. An image forming apparatus comprising:

a recording head which discharges droplets of liquid onto a recording medium;

a dissolved gas amount calculating device which calculates an estimate of an amount of dissolved gas contained in the liquid located inside the recording head, wherein said calculation is based on properties of the liquid or properties of the image forming apparatus;

a liquid restoring device which carries out restoration processing of the liquid located inside the recording head, if the estimate of the amount of the dissolved gas calculated by the dissolved gas amount calculating device exceeds a prescribed reference value;

a liquid supply device which stores the liquid supplied to the recording head; and a dissolved gas amount measuring device which takes a measurement of an amount of the dissolved gas contained in the liquid supplied to the recording head, wherein:

the liquid restoring device includes a liquid expelling device which expels the liquid located inside the recording head to outside of the recording head through discharge holes provided in the recording head, and a deaerating device which removes at least a portion of the dissolved gas contained in the liquid, the deaerating device being disposed on a downstream side of the liquid supply device with respect to the flow direction of the liquid;

the dissolved gas amount measuring device is disposed on a downstream side of the deaerating device with respect to the flow direction of the liquid;

the recording head is disposed on a downstream side of the dissolved gas amount measuring device with respect to the flow direction of the liquid; and if the estimate of the amount of the dissolved gas calculated by the dissolved gas amount calculating device exceeds the reference value, then the liquid restoring device expels the liquid located inside the recording head to the outside of the recording head by means of the liquid expelling device, takes the measurement of the amount of the dissolved gas contained in the liquid supplied from the liquid supply device to the recording head by the dissolved gas amount measuring device, and carries out deaeration processing using the deaerating device in such a manner that the measurement of the amount of the dissolved gas taken by the dissolved gas amount measuring device becomes equal to or less than the reference value.

7. The image forming apparatus as defined in claim 6, further comprising:

a recording head temperature adjusting device which adjusts a maintenance temperature of the recording head; and a recording head temperature adjustment control device which implements control in such a manner that the maintenance temperature of the recording head is lowered using the recording head temperature adjustment device, if the estimate of the amount of the dissolved gas calculated by the dissolved gas amount calculating device has approached the reference value.

8. The image forming apparatus as defined in claim 6, wherein the dissolved gas amount calculating device calculates the estimate of the amount of the dissolved gas contained in the liquid according to a travel time of the liquid moving along a liquid flow path.

* * * * *